US006748775B1

(12) United States Patent
Bucker et al.

(10) Patent No.: US 6,748,775 B1
(45) Date of Patent: Jun. 15, 2004

(54) DEVICE FOR CONNECTING AN EXTERIOR HANDLE TO A CLOSING SYSTEM

(75) Inventors: Rolf Bucker, Coburg (DE); Eberhard Pleiss, Schwaigern (DE)

(73) Assignee: Brose Fahrzeugteile GmbH & Co. KG, Coburg (DE)

( * ) Notice: Subject to any disclaimer, the term of this patent is extended or adjusted under 35 U.S.C. 154(b) by 0 days.

(21) Appl. No.: 09/719,411

(22) PCT Filed: Jun. 4, 1999

(86) PCT No.: PCT/DE99/01696

§ 371 (c)(1),
(2), (4) Date: Dec. 11, 2000

(87) PCT Pub. No.: WO99/64702

PCT Pub. Date: Dec. 16, 1999

(30) Foreign Application Priority Data

Jun. 11, 1998 (DE) ..... 198 26 778

(51) Int. Cl.[7] ..... G05G 5/00; E05B 13/10

(52) U.S. Cl. ..... 70/208; 70/370; 70/451; 292/DIG. 31

(58) Field of Search ..... 70/208, 370, 451, 70/466; 292/DIG. 31, DIG. 53, 336.3

(56) References Cited

U.S. PATENT DOCUMENTS

| | | | | | |
|---|---|---|---|---|---|
| 1,841,570 | A | * | 1/1932 | Burkholder | 292/347 |
| 1,929,741 | A | * | 10/1933 | Hall et al. | 70/14 |
| 2,686,416 | A | * | 8/1954 | Craig | 70/285 |
| 2,686,417 | A | * | 8/1954 | Craig | 70/285 |
| 2,724,958 | A | * | 11/1955 | Psik | 70/181 |
| 4,319,470 | A | * | 3/1982 | White | 292/347 |
| 4,633,690 | A | * | 1/1987 | Foshee | 70/370 |
| 4,671,548 | A | * | 6/1987 | Haberle et al. | 292/216 |
| 5,095,659 | A | * | 3/1992 | Benoit et al. | 292/141 |
| 5,725,262 | A | * | 3/1998 | Kritzler | 292/336.3 |
| 5,927,772 | A | * | 7/1999 | Antonucci et al. | 292/336.3 |
| 5,987,942 | A | * | 11/1999 | Ichinose | 292/336.3 |
| 6,415,636 | B1 | * | 7/2002 | Fukumoto et al. | 292/336.3 |
| 6,494,066 | B2 | * | 12/2002 | Muneta | 70/208 |
| 6,550,295 | B2 | * | 4/2003 | Hubner | 70/208 |

FOREIGN PATENT DOCUMENTS

| | | |
|---|---|---|
| DE | 30 30 519 | 8/1982 |
| DE | 36 10 536 | 10/1987 |
| DE | 44 05 383 | 4/1995 |
| DE | 196 19 869 | 12/1996 |

* cited by examiner

*Primary Examiner*—John B. Walsh
(74) *Attorney, Agent, or Firm*—Christie, Parker & Hale, LLP

(57) ABSTRACT

A device for opening wings of a motor vehicle, more particularly for opening vehicle doors and vehicle hinged lids. An exterior handle is connected to a closing system. The exterior handle is arranged in the exterior skin of the a motor vehicle and is subjected to the action of a spring force. The exterior handle includes a holding fixture which can be brought into contact in an interactive manner with a connecting element which can be inserted from the exterior. In addition, the one end of the connecting element which is assigned to the closing system can be interactively connected to an actuating element which unlatches the one blocking element of the closing system. The other end of the connecting element is displaceably mounted on an insertion part which can be inserted from the exterior skin and which can be fixed with regard to the exterior skin.

11 Claims, 8 Drawing Sheets

DEVICE FOR CONNECTING AN EXTERIOR HANDLE TO A CLOSING SYSTEM

CROSS-REFERENCE TO RELATED APPLICATION

This application claims priority of PCT International Application Number PCT/DE99/01696 filed on Jun. 4, 1999 and German patent Application No. 19826778.9, filed on Jun. 11, 1998.

FIELD OF THE INVENTION

The invention relates to a device for opening wings of a motor vehicle, more particularly for opening vehicle doors and vehicle hinged lids.

BACKGROUND

From DE 44 05 383 A1 an exterior handle assembly for a motor vehicle door is known having a bearing yoke which can be prefitted on the inside of the door exterior panel and in which are installed a draw bar separated from the door handle and acting on a lock release lever, as well as a holding plate for a closing cylinder. The door handle, which is loaded with spring force, and the closing cylinder are able to be mounted from outside by means of a detent device when the door is closed. For assembly, three openings are provided, namely a bearing opening for mounting the door handle, an operating opening for connecting the door handle to the draw bar, as well as a closing opening for the closing cylinder.

The known exterior handle assembly has a number of complicated individual parts so that the cost of manufacturing and assembling the known exterior door assembly is really quite high. Furthermore there is the drawback that the known assembly takes up a lot of room in the space between the exterior panel of the door and the interior panel. Furthermore the assembly has a relatively large number of openings in the exterior panel of the door which have to be sealed at high cost in order to prevent moisture from penetrating into the space between the interior and exterior panels of the door.

Furthermore, in order to connect the exterior handle assembly to the locking system (door lock), there are always at least three assembly steps which are required. First the draw bar which acts on the lock release lever has to be pre-assembled. Then in individual assembly steps, the door handle is connected to the draw bar, and the closing cylinder is connected to the locking system.

Thus there is a need for a device for opening wings of a motor vehicle which is simple and cost-effective to manufacture and which can be fitted at low cost.

SUMMARY OF THE INVENTION

The device according to the invention has the advantage that an exterior handle of a wing, e.g. a door, and a connecting element which can be inserted from the exterior skin of a motor vehicle can be brought into interaction with each other so that the exterior handle and the connecting element are mutually entrained. By way of example, when the exterior handle is operated to open a vehicle door, the exterior handle entrains the connecting element. During the reverse procedure, the connecting element then entrains the exterior handle. The connecting element thereby serves as a connection between the exterior handle and a closing system of the door.

The device according to the invention furthermore has a small number of individual parts which can be manufactured without complication and at low cost. Furthermore, the small number of parts and their simple method of construction enables a low-cost assembly. More particularly, it is possible by means of an individual assembly step to connect the exterior handle to the closing system fixed inside a bodywork chamber. The term "closing system" is meant here as a lock with its individual components.

The space required by the device is small so that it can be installed without problem, in particular, in doors having a small structural space. Additionally, there is the special advantage that the device for connecting the exterior handle to the closing system enables fitting to be carried out from the outside of the door. In this way, assembly is particularly easy and simple. It is also ensured that a door which is already painted no longer becomes scratched during the assembly.

According to the invention, the connecting element is displaceably mounted on an insert part which can be inserted from the exterior skin of the vehicle door, and can be fixed relative to the exterior skin. This insert part preferably has a closing cylinder for manually actuating the closing system. As an alternative or in addition the insert part has an infrared receiver of an infrared control for automatically actuating the closing system.

In a further development of the invention the insert part has an illumination unit. This makes it easier to actuate the closing system manually by means of the closing cylinder in darkness.

A rotatable paddle of the closing cylinder mounted in the insert part is preferably in engagement with a follower of the closing system. By operating the closing cylinder, the paddle is moved so that a blocking element of the closing system is unlatched or locked.

A compression spring is preferably supported between the insert part and the connecting element for spring-tensioning the exterior handle. This compression spring serves to reset the exterior handle and connecting element. It is thus not necessary to provide a separate individual return spring for each of the exterior handle and connecting element. Furthermore, the compression spring restricts at the same time the setting path of the exterior handle. As an alternative, or in addition to the compression spring described, it is proposed to tension the exterior handle through a spring with a handle shell of the vehicle door.

The advantage of these spring arrangements is that by deliberately saving space the entire assembly becomes more compact and the manufacturing costs are reduced through the lower number of component parts.

In a further development of the invention, the insert part can be fixed relative to the exterior skin through an opening in the interior skin. By way of example, fixing is carried out by a positive locking connection between the insert part and handle shell.

The connection between the blocking element and the connecting element is preferably produced by snap-fitting or detent elements. By way of example, a detent element is provided on the blocking element and engages in a detent opening of the connecting element. As an alternative, or in addition to this it is proposed that the connection between the blocking element and connecting element is undertaken by a separate part which can be actuated through the interior skin of the vehicle door, for example, an actuating element which acts on the blocking element. For this, the interior skin has an assembly and dismantling opening for producing and disengaging the connection between the connecting element and closing cylinder.

In a further development of the invention, the blocking element is designed as a locking pawl which interacts with a rotary spring bolt of the door lock provided as the closing system. The locking pawl prevents the movement of the rotary spring bolt when the vehicle door is closed. By actuating the exterior handle the locking pawl is moved so that it releases the rotary spring bolt and the vehicle door can be opened through rotation of the rotary spring bolt with further actuation of the exterior handle.

The idea on which the invention is based will now be explained in further detail with reference to the embodiments illustrated in the drawings.

DETAILED DESCRIPTION

Figure 1:
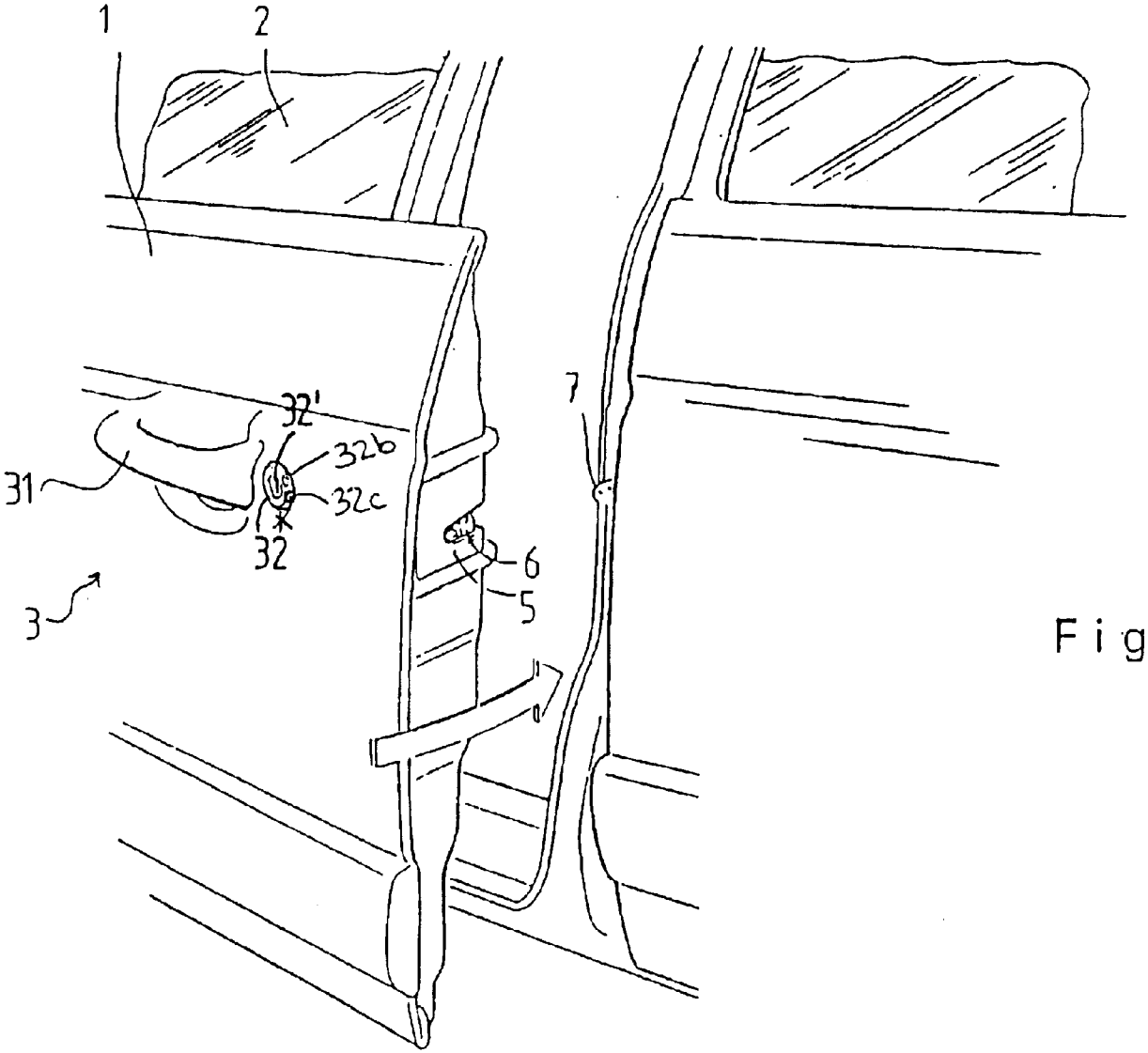
FIG. 1 is a perspective view of a section of a motor vehicle body with a vehicle door.

FIG. 1 shows an opened vehicle door 1 on which a window pane 2 is mounted. The vehicle door 1 has an exterior handle assembly 3 with exterior handle 31, an insert part 32 as well as a closing cylinder 32'. The closing cylinder 32' is thereby mounted in the insert part 32. The insert part 32 can also include an illumination unit 32*c*. Both the insert part 32 and exterior handle 31 are able to be mounted from the outside of the door. closed, the rotary spring bolt engages round a closing element 7 mounted on the B-pillar of the vehicle body.

Figure 2:
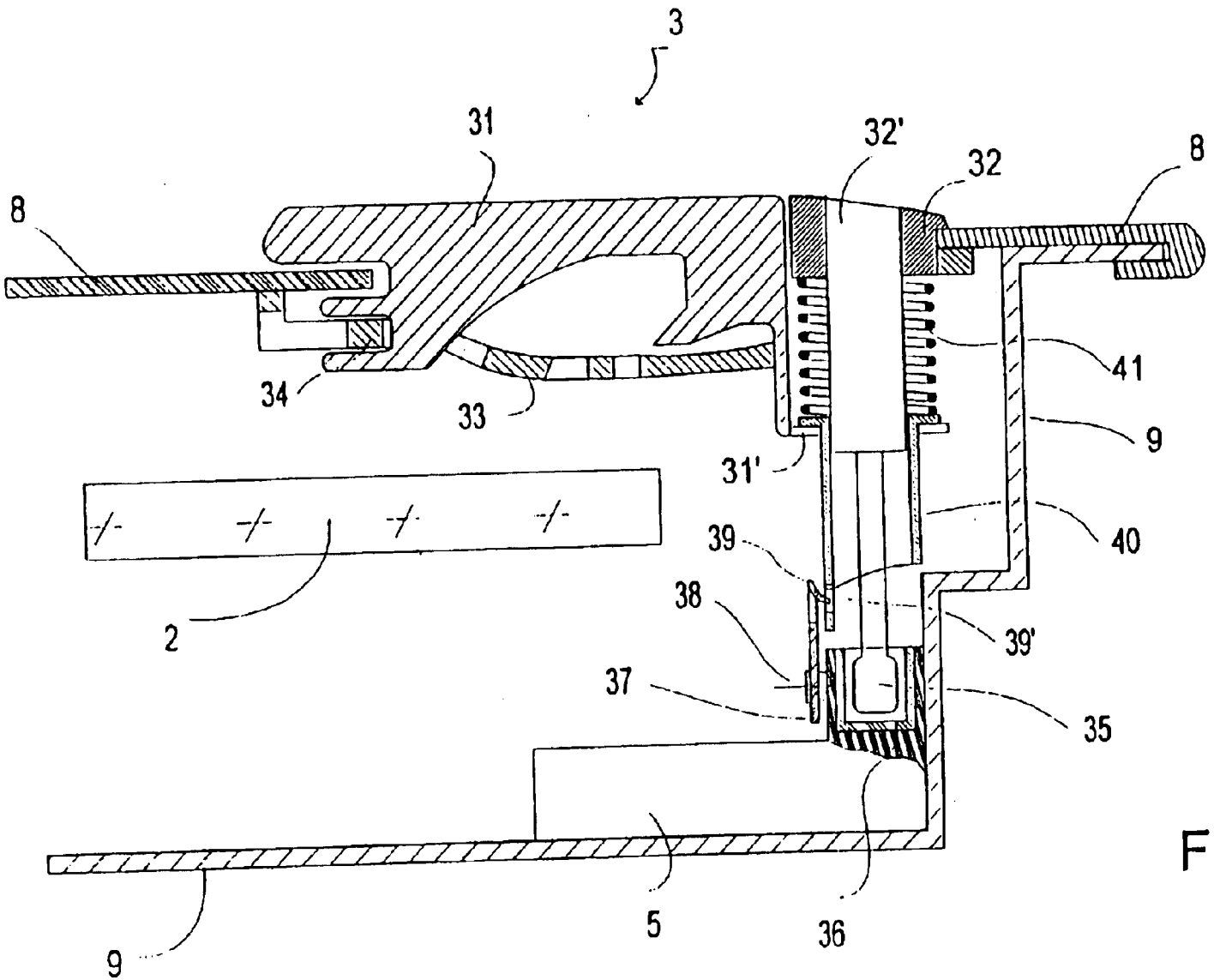
FIG. 2 is a diagrammatic partial sectional view of an exterior handle of the vehicle door according to FIG. 1 connected to a door lock.

FIG. 2 shows the exterior handle 31 mounted on the door exterior panel 8 of the vehicle door 1 and connected to the door lock 5. This is part (f the exterior handle arrangement 3 which is provided for operating the aforementioned locking pawl, rotary spring bolt 6 and locking of the door lock 5 and is fitted into the end of the vehicle door 1 directed towards the B-pillar. The locking pawl and rotary spring bolt 6 are not shown in FIG. 2.

The door exterior panel 8 of the vehicle door 1 is assigned a door interior panel 9 which are both provided as supports for various assemblies and modules, such as for example, an electric window lifter. On the door exterior panel 8 is a handle shell 33 into which the exterior handle 31 is inserted and supported to swivel about a bearing 34. Thus the exterior handle 31 can be swivelled up out of the starting position shown by lifting its operating end which is opposite the bearing 34.

A holding fixture 31' formed in one piece on the exterior handle 31 and holding a sliding sleeve 40 projects into an assembly opening of the handle shell 33. The sliding sleeve 40 lies on the holding fixture 31' of the exterior handle 31 both during actuation and non-actuation of the exterior handle 31. In an alternative embodiment (not shown here) it is proposed to only bring the sliding sleeve 40 into connection with the exterior handle 31 when the said exterior handle 31 is actuated.

The sliding sleeve 40 is mounted displaceable on the closing cylinder 32' which is mounted in the insert part 32. As an alternative or in addition to this, it is proposed to mount the sliding sleeve 40 displaceable on the insert part 32 itself, as will be explained in further detail below.

A compression spring 41 is mounted between the end of the sliding sleeve 40 resting on the exterior handle 31, or 31', and the insert part 32, and completely encloses the closing cylinder 32'. This compression spring 41 is provided as a return spring of the external handle 31 or 31', and the sliding sleeve 40, which will be described in further detail below.

The insert part 32 is mounted and fixed in the door exterior panel 8 so that it is secured against unauthorized removal. This security action is provided by a detent connection (not shown) of the insert part 32 with the door exterior panel 8. In order to prevent moisture from penetrating into the interspace between the door exterior panel 8 and door interior panel 9, a seal (likewise not shown here) is mounted between the door exterior panel 8 and insert part 32. This is of particular advantage for the proper functioning of the electric and/or electronic elements mounted in the vehicle door 1, such as for example, sensors of a central locking system. In addition, further seals (not shown in further detail) are provided between the exterior handle 31 and door exterior panel 8 and the handle shell 33.

The closing cylinder 32' has a paddle 35 which is in active connection with a lock follower 36 of the door lock 5 mounted on the door interior panel 9. By operating the closing cylinder 32', the paddle 35 is moved so that the locking pawl or rotary spring bolt 6 of the door lock 5 is unlatched or locked.

The door lock 5 is connected to the sliding sleeve 40 through an operating lever 37 which is provided for actuating the locking pawl and rotary spring bolt 6. To this end, the operating lever 37 has a detent element 39 which can lock in an opening 39' of the sliding sleeve 40. The connection between the door lock 5 and operating lever 37 is produced through a screw connection 38. As an alternative to this however any other type of connection is also possible.

The exterior handle arrangement 3 described here, with its connection between the exterior handle 31 and door lock 5, has many advantages. It requires only a small number of individual parts and is therefore cost-effective to manufacture. Furthermore, the assembly costs are very slight. This is due, on the one hand, to the small number of individual parts required and, on the other, to the small number of assembly steps which are necessary in order to fit the exterior handle assembly 3 into the vehicle door 1. The number of assembly steps is substantially restricted to two steps. In a first step, the exterior handle 31 is inserted into the handle shell 33. Then the insert part 32 is inserted together with the closing cylinder 32' and sliding sleeve 40 into the aforementioned assembly opening and connected to the door lock 5. The sliding sleeve 40 is thereby mounted on the exterior handle 31, 31' and engaged in the door lock 5 by means of the detent connection 39, 39'. This single assembly movement thus ensures that both the insert part 32 is connected with the closing cylinder 32' and also the exterior handle 31 or 31' is connected with the door lock 5 through the sliding sleeve 40. No additional assembly step is therefore required to connect the exterior handle 31 to the door lock 5.

A further advantage lies in the small amount of space required. This is small so that the device according to the invention can be fitted particularly well in vehicle doors having a small assembly space. These are, for example, vehicle doors of mini-vans and also vehicle doors where a number of other modules (window lifter, speaker etc) are fitted which likewise take up a certain amount of assembly space.

The opening of the vehicle door 1 by means of the exterior handle assembly 3 described above will now be explained briefly. In order to open the vehicle door 1 first, the locking pawl or rotary spring bolt 6 of the door lock 5 must be unlatched by actuating the closing cylinder 32'. Then by actuating the exterior handle 31 the locking pawl is moved so that the rotary spring bolt 6 is released and is turned by pulling on the exterior handle 31. The vehicle door 1 can then be opened. If the exterior handle 31 is now let go, then both the exterior handle 31 and also the sliding sleeve 40 are pushed simultaneously through the single compression spring 41 into their original position. The arrangement of a second return spring is therefore not necessary. This saves further space so that the exterior handle assembly becomes further compact.

As mentioned above, the insert part 32 is connected and fixed to the door exterior panel 8 by means of a detent connection according to FIG. 2. An alternative fixing is shown in FIGS. 2*a* and 2*b*.

Figure 2A:
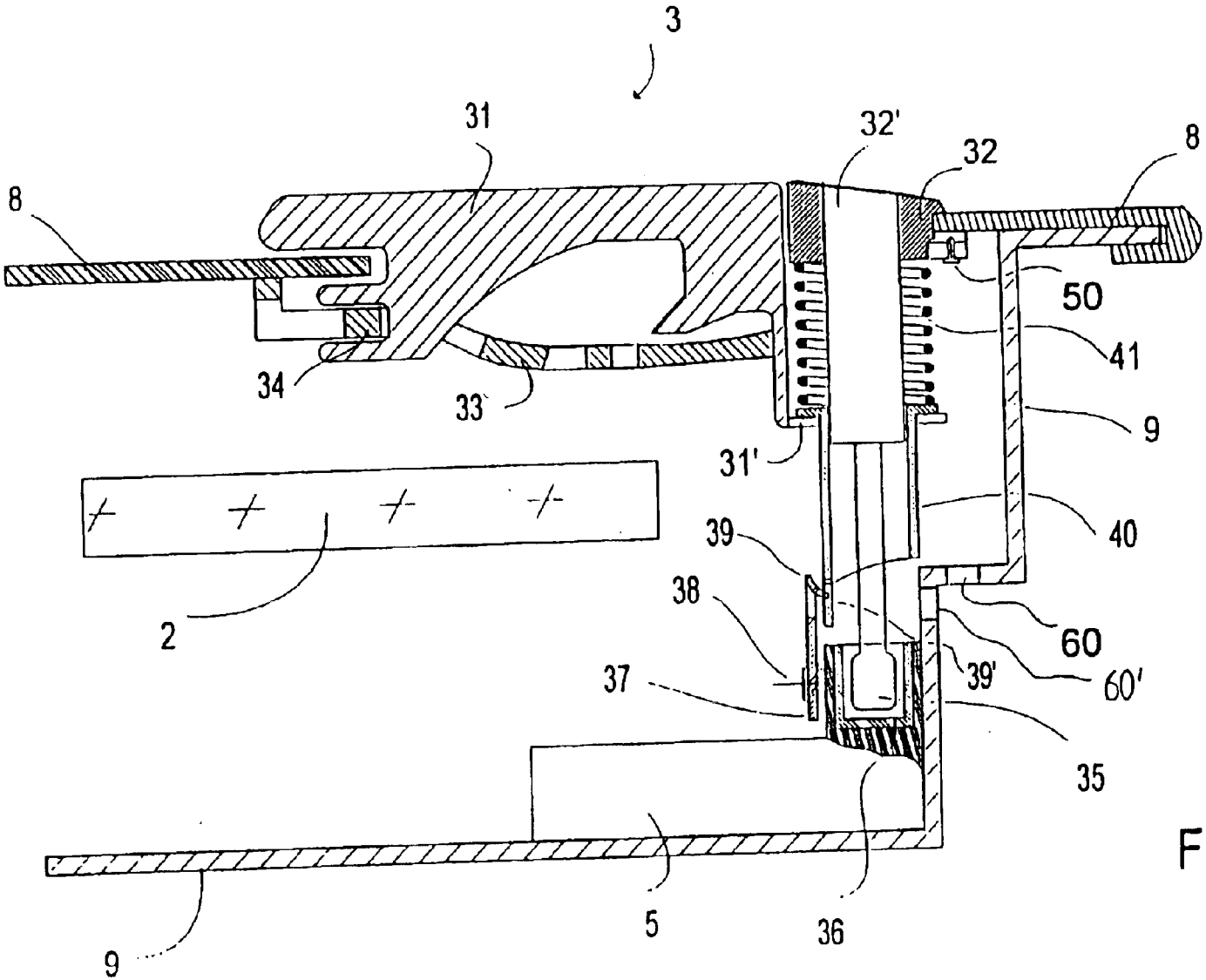
FIGS. 2*a* and 2*b* are views according to FIG. 2 with fastening devices for an insert part.
Figure 2B:
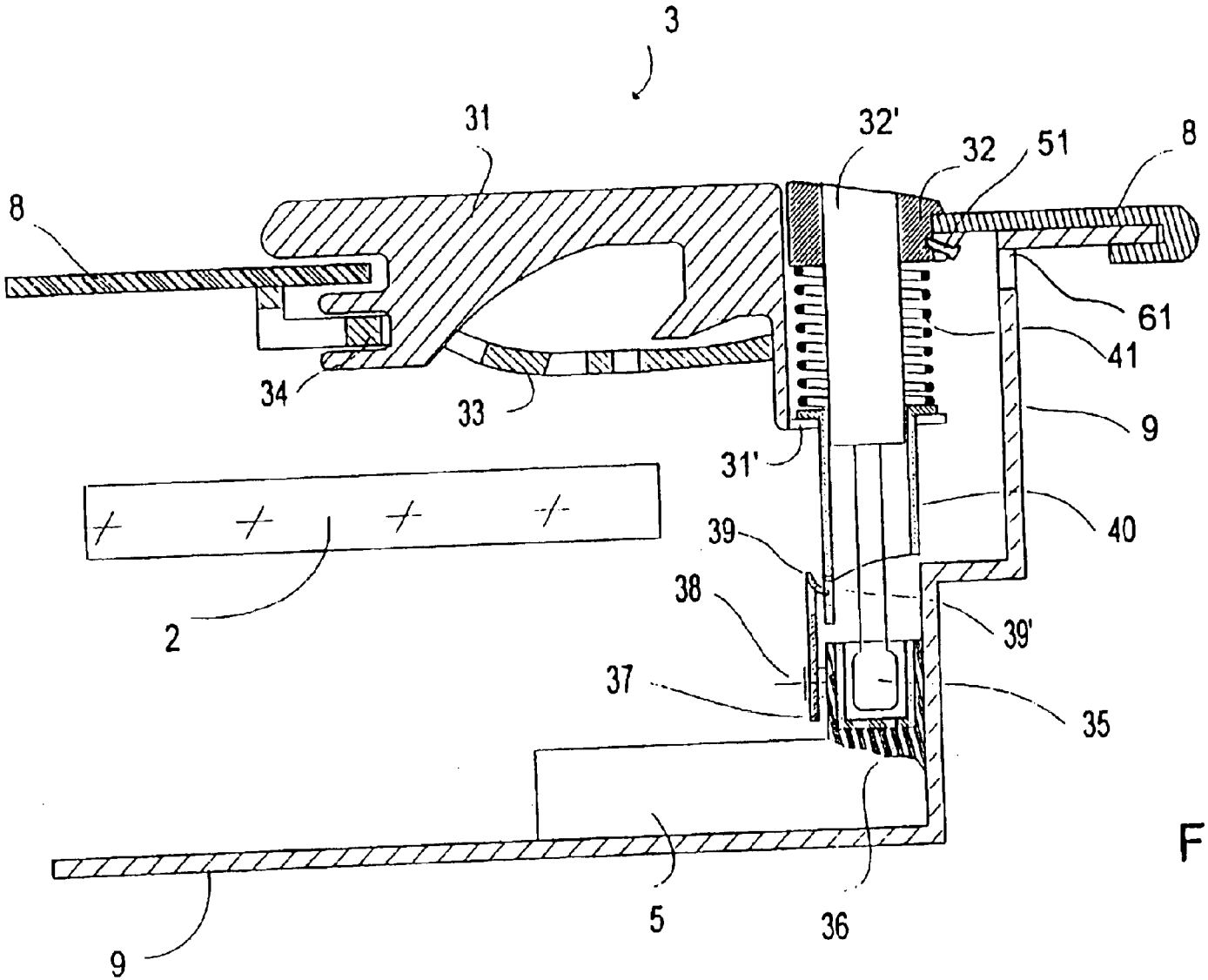

FIG. 2*a* shows the fixing of the insert part 32 by means of a screw connection 50 on the handle shell 33. A further possible screw connection 51 of the insert part 32 with the handle shell 33 is shown in FIG. 2*b*. Openings 60 and 61 are provided in the door interior panel 9 for the purpose of assembling and dismantling these screw connections 50 and 51. These are readily accessible when the vehicle door 1 is opened so that the screw connection 50 and 51 can be easily assembled and dismantled without problem.

As shown in FIG. 2*a*, a further opening 60' is provided for releasing the detent connection between the operating lever 37 and sliding sleeve 40, which is likewise readily accessible when the vehicle door 1 is opened.

Figure 2C:
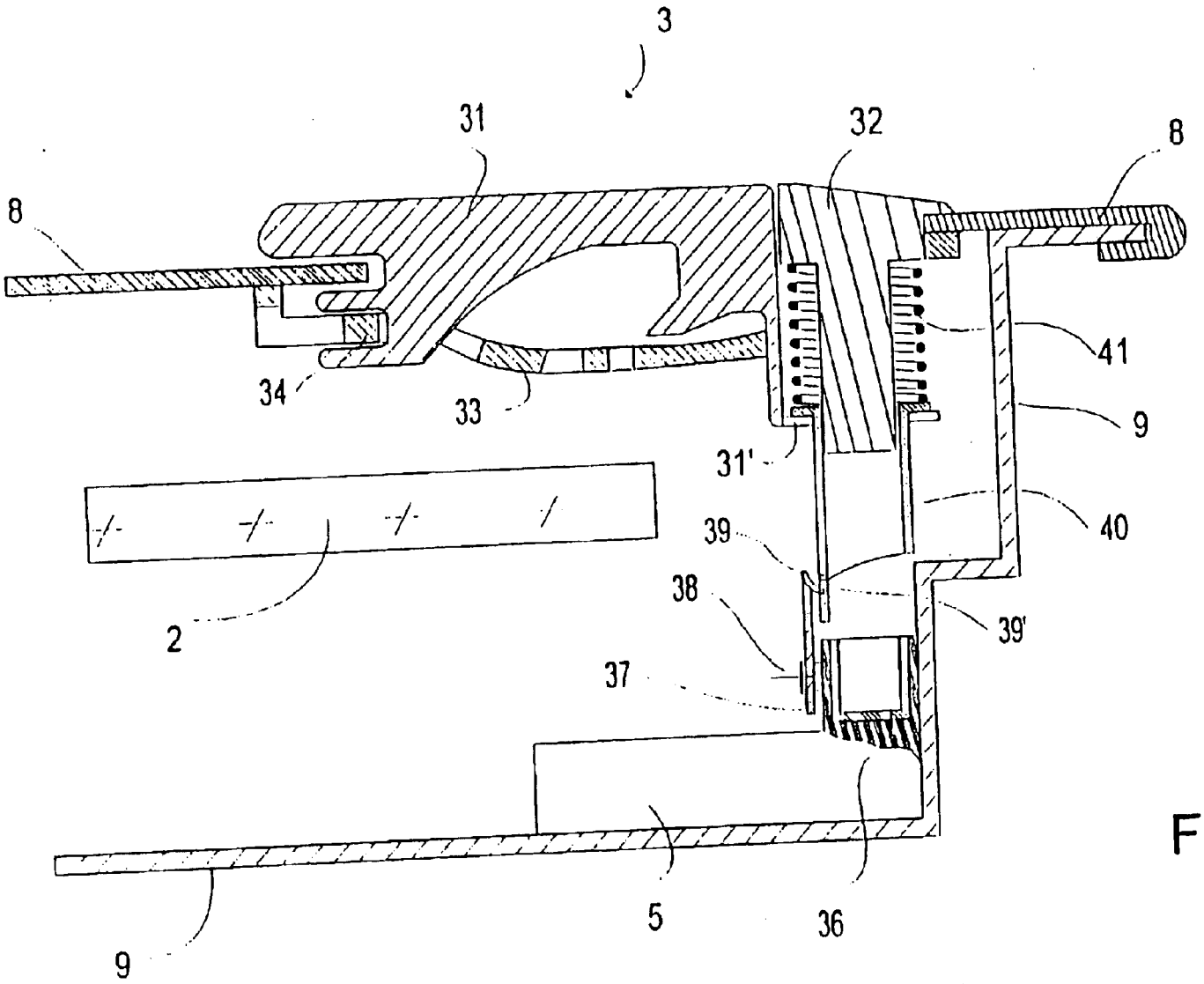
FIG. 2*c* is a diagrammatic partial sectional view of the exterior handle connected to the door lock and an infrared receiver mounted in the insert part.

FIG. 2*c* shows the exterior handle 31, which is connected to the door lock 5, and whose associated insert part 32 has no closing cylinder but an infrared receiver 32*b* (shown in FIG. 1) of an automatic control system of the door lock 5. The infrared receiver 32*b* serves to receive a control signal with which the locking pawl or rotary spring bolt 6 of the door lock 5 is unlatched and locked by means of servo motors (not shown). The embodiment illustrated here is particularly suitable for passenger doors and boot lids. For the vehicle door it is advantageous to provide the insert part 32 with both the infrared receiver 32*b* of the automatic control system of the door lock 5 and a closing cylinder 31' for emergency opening of the vehicle door.

Figure 2D:
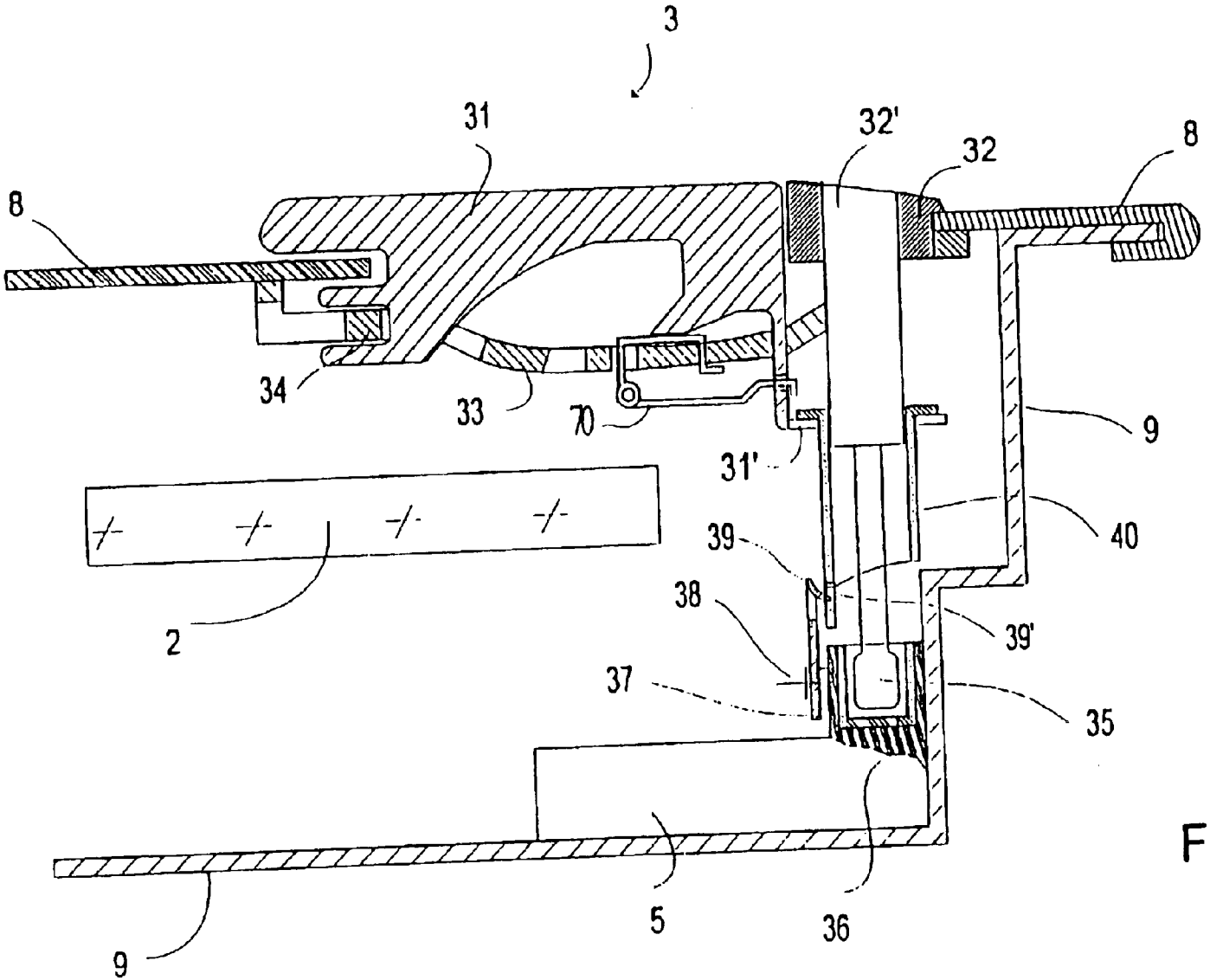
FIG. 2*d* is a diagrammatic partial sectional view of the exterior handle connected to the door lock and tensioned with a handle shell.

A further possible arrangement of the spring system of the exterior handle 31 is shown in FIG. 2*d*. The exterior handle 31 is thereby tensioned with the handle shell 33 by means of a yoke spring 70 so that it is pushed after its actuation together with the sliding sleeve 40 back again into the original position prior to actuation.

Figure 3:
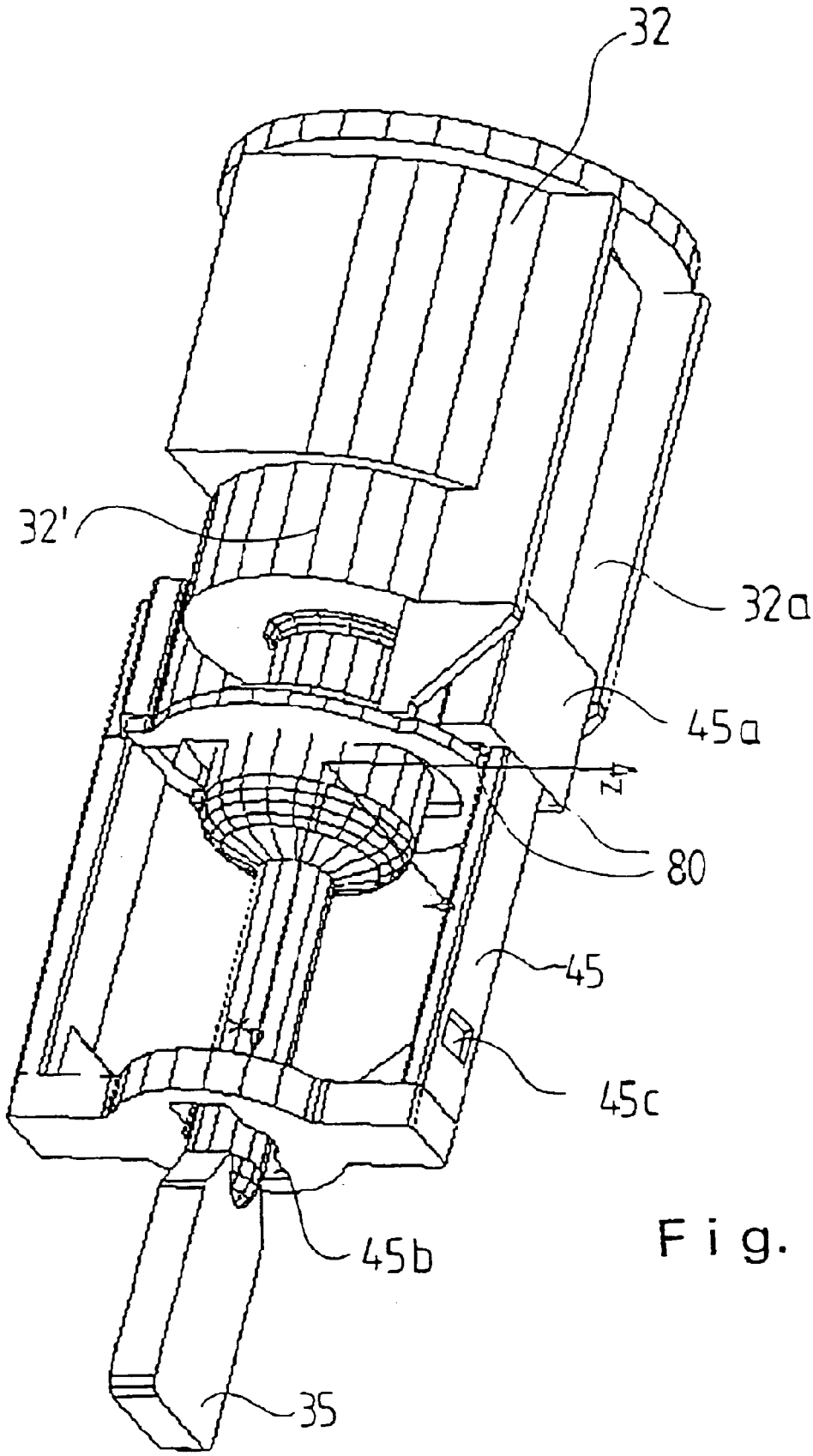
FIG. 3 is a perspective view of the insert part with a closing cylinder and connecting element.

FIG. 3 shows on an enlarged scale a further embodiment of an insert part 32 with a closing cylinder 32' and a U-shaped connecting element 45.

A closing cylinder 32' is mounted centrally in the insert part 32 and its paddle 35 projects through an opening 45*b* of the connecting element 45. Furthermore the insert part 32 has on either side guides 32*a* for guiding the guide elements 45*a* of the connecting element 45.

The door lock 5 (not shown here) is connected to the connection element 45 through a detent connection. The connecting element 45 has an opening 45*c* into which a detent element (not shown here) of the door lock 5 engages for connecting the door lock 5 directly to the connecting element 45.

The exterior handle 31 (not shown) lies in this embodiment on the stop faces 80 of the guide elements 45*a*. If the exterior handle 31 is actuated, then the connecting element 45 is moved along the guides 32*a* towards the head of the insert part 32. A compression spring 41, whose arrangement is shown in FIG. 4, is thereby compressed so that after actuation of the exterior handle 31 (letting go the exterior handle) the exterior handle 31 and connecting element 45 are moved back into their original position prior to the actuation of the exterior handle.

Figure 4:
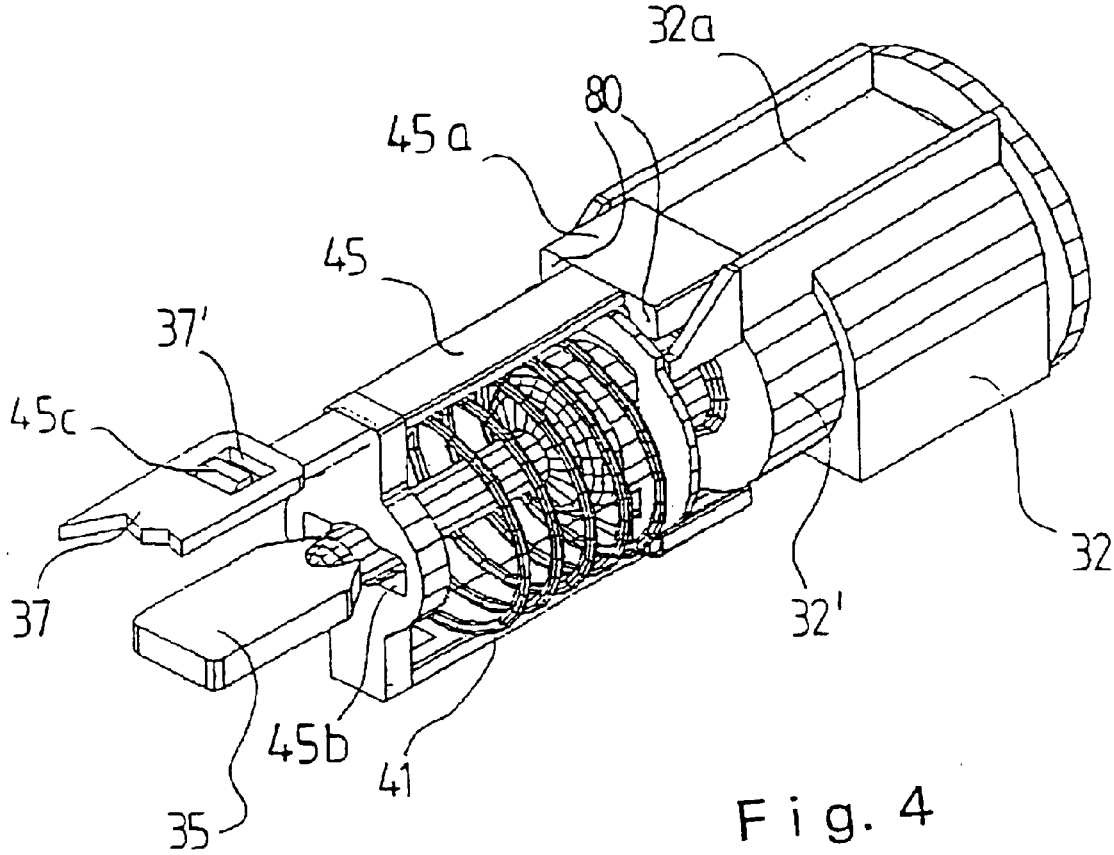
FIG. 4 is a perspective view of an alternative embodiment of an insert part with the closing cylinder and connecting element according to FIG. 3.

The connecting element 45, shown in FIG. 4 has, unlike the connecting element shown in FIG. 3, an indirect connection with the door lock 5. For this, a detent element 45*c* is mounted on the connecting element 45 and engages in an opening 37' of the operating lever 37. This operating lever 37 is, as already explained above, connected to the door lock 5 and serves to actuate the locking pawl or rotary spring bolt 6 of the door lock 5.

What is claimed is:

1. A device for opening wings of a motor vehicle, comprising:

an exterior handle mounted on an exterior skin of the motor vehicle and loaded with spring force, and a closing system fixed inside a bodywork space of the motor vehicle, wherein the exterior handle has a holding fixture which can be brought into contact in an interactive manner with a connecting element which can be inserted from the exterior skin, wherein one end of the connecting element is displaceably mounted on an insert part which can be inserted from the exterior skin and can be fixed relative to the exterior skin, wherein the other end of the connecting element can be connected in active engagement with an actuating element which unlatches a blocking element of the closing system, wherein the insert part has a closing cylinder, and wherein the closing cylinder engages with a follower of the closing system through a rotatable paddle.

2. The device of claim 1, wherein the insert part has an infrared receiver.

3. The device of claim 1 or 2, wherein the insert part has illumination means.

4. The device of claim 1, wherein a compressing spring is supported between the insert part and the connecting element to resiliently support and restrict the setting path of the exterior handle.

5. The device of claim 1, wherein the exterior handle for resilient support is tensioned with a handle shell through a spring.

6. The device of claim 1, wherein the insert part can be fixed relative to the exterior skin through at least one opening in an interior skin of the wing.

7. The device of claim 1, wherein the insert part is connected for positive locking engagement with a handle shell.

8. A device for opening wings of a motor vehicle, comprising:

an exterior handle mounted on an exterior skin of the motor vehicle and loaded with spring force, and a closing system fixed inside a bodywork space of the motor vehicle.

wherein the exterior handle has a holding fixture which can be brought into contact in an interactive manner with a connecting element which can be inserted from the exterior skin, wherein one end of the connecting element is displaceably mounted on an insert part which can be inserted from the exterior skin and can be fixed relative to the exterior skin, wherein the other end of the connecting element can be connected in active engagement with an actuating element which unlatches a blocking element of the closing system, and wherein the connection between the blocking element and the connecting element is through at least one of snap and detent elements.

9. A device for opening wings of a motor vehicle, comprising:

an exterior handle mounted on an exterior skin of the motor vehicle and loaded with spring force, and a closing system fixed inside a bodywork space of the motor vehicle, wherein the exterior handle has a holding fixture which can be brought into contact in an interactive manner with a connecting element which can be inserted from the exterior skin, wherein one end of the connecting element is displaceably mounted on an insert part which can be inserted from the exterior skin and can be fixed relative to the exterior skin, wherein the other end of the connecting element can be connected in active engagement with an actuating element which unlatches a blocking element of the closing system, wherein the connection between the blocking element and the connecting element is through a separate connecting part which can be actuated through an interior skin of the wing.

10. The device of claim 9, wherein the interior skin has at least one assembly/dismantling opening for producing and releasing the connection between the connecting element and the closing system.

11. The device of claim 1, wherein a locking pawl is the blocking element.

* * * * *